US006633266B2

(12) United States Patent
Blen et al.

(10) Patent No.: US 6,633,266 B2
(45) Date of Patent: Oct. 14, 2003

(54) ANTENNA SYSTEM INCORPORATING MOVABLE PLATFORM

(75) Inventors: Albert Louis Blen, Anaheim, CA (US); Glen J. Desargant, Fullerton, CA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 10/097,696

(22) Filed: Mar. 13, 2002

(65) Prior Publication Data

US 2003/0174094 A1 Sep. 18, 2003

(51) Int. Cl.[7] ..... H01Q 1/18
(52) U.S. Cl. ..... 343/882; 343/765
(58) Field of Search ..... 343/882, 763, 343/766, 765, 757, 759, 878, 880, 711

(56) References Cited

U.S. PATENT DOCUMENTS 4,819,002 A * 4/1989 Reboullet ..... 343/765
5,453,753 A * 9/1995 Cosenza et al. ..... 343/765
5,485,169 A * 1/1996 Kitabatake et al. ..... 343/765

* cited by examiner

*Primary Examiner*—James Clinger
(74) *Attorney, Agent, or Firm*—Harness Dickey & Pierce P.L.C.

(57) ABSTRACT

An antenna system adapted to be mounted on an exterior surface of a mobile platform and having a reduced overall height to reduce aerodynamic drag caused by the antenna system. The antenna system includes a movable platform disposed concentrically within an annular stationary platform. The movable platform includes a slip ring assembly formed on its lower surface which is in physical contact with a brush assembly supported from a lower surface of the stationary platform. By locating the slip ring assembly and the brush assembly adjacent the lower surface of the movable platform, the overall height of the antenna is reduced. Reliability is also improved since contaminants are less likely to accumulate on the slip ring assembly due to its presence on the lower surface of the movable platform.

18 Claims, 3 Drawing Sheets

ANTENNA SYSTEM INCORPORATING MOVABLE PLATFORM

TECHNICAL FIELD

The invention relates to the antenna systems, and more particularly to the incorporation of slip rings and brushes for an antenna of the system to facilitate an electrical connection to electrical components associated with the antenna while permitting rotational movement of the antenna, and while reducing the overall height of the system.

BACKGROUND OF THE INVENTION

Any antenna that rotates about an azimuthal axis beyond 360° of rotation requires some means for maintaining electrical contact between the electronic components associated with the antenna and those in the supporting structure on which the antenna is mounted. One form of maintaining such an electrical coupling is through the use of conventional slip rings and brushes. Slip rings and brushes can be used to supply power to the various electrical/electronic components of the antenna such as the azimuthal and elevation drive motors, which allow positioning of the antenna in accordance with desired azimuth and elevation angles. Other electronic components that require electrical power and/or electrical control signals are gyroscopes and encoders that help to control pointing of the antenna.

Typically, the above-described slip rings and brushes are mounted on a top surface of an antenna base plate. However, such an arrangement serves to increase the overall height of the antenna system. Also, for a system with a large base, this would necessitate that the brushes extend across the base to reach the slip rings. Such a design would inhibit the attachment of other components onto the base because they would interfere with the brush holders as they would rotate. On high speed moving platforms, such as jet aircraft, the additional drag caused by an externally mounted antenna system is of serious concern. The additional drag can significantly reduce fuel economy of the aircraft and thus lead to higher operating costs for the aircraft.

It is therefore of principal importance that an apparatus used for supporting an antenna and its associated components be formed such that the overall height of the antenna can be kept to a minimum to thereby avoid negatively impacting the performance and cost associated with using an externally mounted antenna on a high speed moving platform such as a jet aircraft.

SUMMARY OF THE INVENTION

The present invention is directed to an antenna system apparatus for supporting an antenna which allows 360° rotational movement of the antenna, and which provides a significantly lower height that previously designed antenna support systems. The apparatus of the present invention makes use of a movable platform for mounting an antenna thereon, and a stationary platform mounted adjacent the movable platform. The antenna is mounted on an upper surface of the movable platform and at least one slip ring is formed on a lower surface of the movable platform. More preferably, a plurality of slip rings are formed on the lower surface of the movable platform.

At least one brush, and more preferably a plurality of brushes, are mounted on a support such that the brushes can be placed in physical contact with the slip rings. A motor operatively associated with the movable platform is used to drive the movable platform rotationally about the stationary platform. In a preferred embodiment, the stationary and movable platforms are disposed generally coplanar to one another and incorporate a bearing assembly therebetween for facilitating smooth rotational movement of the movable platform. This slip ring design is not limited to coplanar mounting plates or the bearings integrated into those plates.

It is a principal advantage of the present invention that the slip rings and brushes are disposed adjacent the lower surface of the movable platform. This allows the overall height of the apparatus to be minimized by allowing the various electrical and electronic components associated with the antenna to be mounted directly on the upper surface of the movable platform, rather than on other structure disposed above the upper surface, which is common with previous antenna systems. This in turn helps to reduce the drag created by the antenna system when it is mounted on an external surface of a high speed mobile platform.

In a preferred embodiment the apparatus of the present invention comprises a circular movable platform and an annular stationary platform. A bearing assembly is disposed between an outer edge surface of the circular movable platform and an inner edge surface of the annular stationary platform. The bearing assembly facilitates smooth rotational movement of the movable platform.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
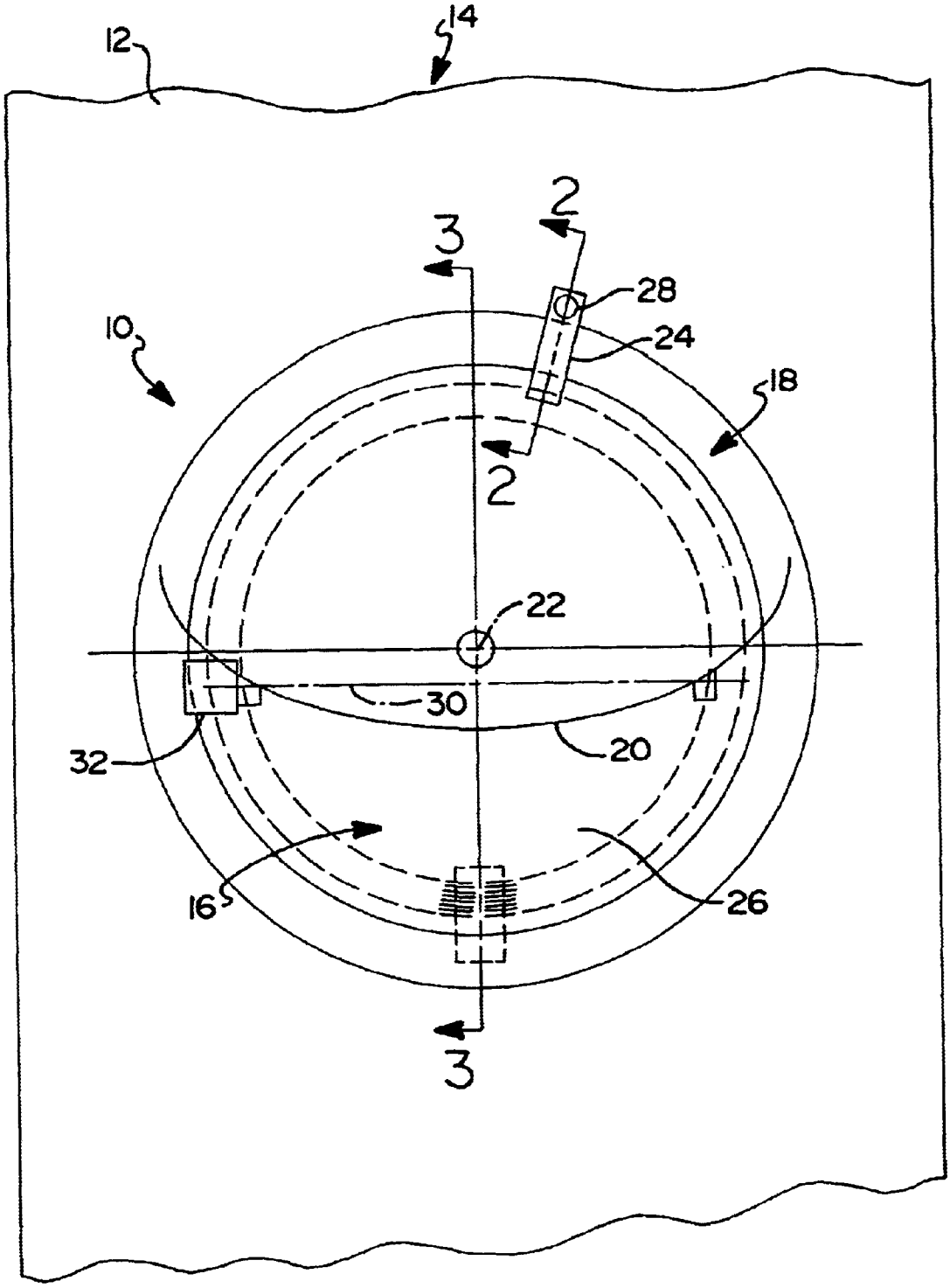
FIG. 1 is a simplified plan view of an antenna system 10 in accordance with a preferred embodiment of the present invention.

Referring to FIG. 1, there is shown an antenna system 10 in accordance with a preferred embodiment of the present invention. The antenna system 10 is shown mounted on an external surface 12 of a mobile platform 14. The mobile platform 14 may comprise any form of mobile platform such as a land vehicle, a ship or an aircraft. It is anticipated that the antenna system 10 will find particular utility in connection with high speed commercial and military aircraft. In such applications, it will be appreciated that an extremely important consideration is minimizing drag created by the antenna system 10. To this end, minimizing the overall height of the antenna system 10 is of paramount importance. The present invention accomplishes this goal through a unique arrangement of electrical coupling elements, which will be described below momentarily.

With further reference to FIG. 1, the antenna system 10 includes a movable circular platform 16 and a stationary annular platform 18. The movable platform 16 has mounted thereon a reflector antenna 20 for receiving and/or transmitting radio frequency signals. While the antenna 20 is shown as reflector antenna, it will be appreciated that the movable platform 16 is capable of supporting a planar, phased array antenna or virtually any other form of antenna. The movable platform 16 rotates the antenna 20 about an azimuthal axis 22 so that the antenna 20 can be pointed at any desired azimuth scanning angle.

For moving the movable platform 16, a support bracket 24 is fixedly coupled to an upper surface 26 of the platform 16. The support bracket 24 carries a motor 28, which may comprise any form of motor but one preferred form comprises a stepper motor. The motor 28 is carried at an outermost end of the support bracket 24. The antenna 20 is further rotatable about an elevation axis 30 via a motor 32 mounted on the supper surface 26 or on a suitable bracket supported on the upper surface 26 of the movable platform 16. Accordingly, the antenna can also be pointed at any desired elevation scanning angle.

Figure 2:
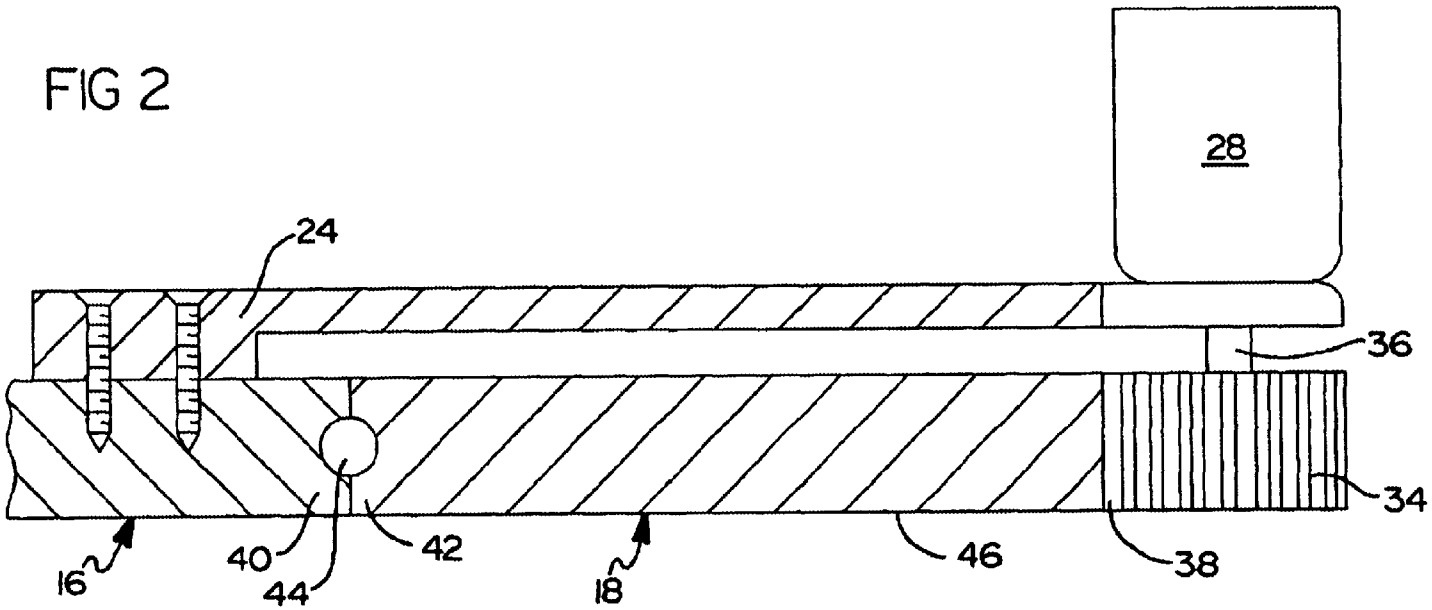
FIG. 2 is a cross-sectional view of a portion of the apparatus of FIG. 1 taken in accordance with section line 2—2 in FIG. 1.

Referring to FIG. 2, the azimuth motor 28 includes a gear, which is shown as a pinion gear 34. The pinion gear 34 is driven via an output shaft 36 of the motor 28 and engages a toothed exterior edge surface 38 of the stationary platform 18. An outer edge surface 40 of the movable platform 16 is disposed generally coplanar with an inner edge surface 42 of the stationary platform 18 and a bearing assembly 44 is interposed between the surfaces 40 and 42. The bearing assembly 44 allows the movable platform 16 to move smoothly rotationally about the azimuthal axis 22 when the pinion gear 34 is driven by the motor 26. Thus, it will be appreciated that the support bracket 24, the motor 28 and the pinion gear 34 all move concurrently with the movable platform 16 during rotational movement of the platform 16. Similarly, the elevation motor 32 rotates with the movable platform 16. It will be appreciated, however, that other bearings and/or drive arrangements could just as easily be implemented and, that the above-described arrangement is meant to merely illustrate one suitable driving arrangement for the movable platform 16. One preferred form of drive mechanism is disclosed in co-pending U.S. application Ser. No. 09/975,858, filed Aug. 12, 2001, assigned to the Boeing Co., and hereby incorporated by reference.

Figure 3:
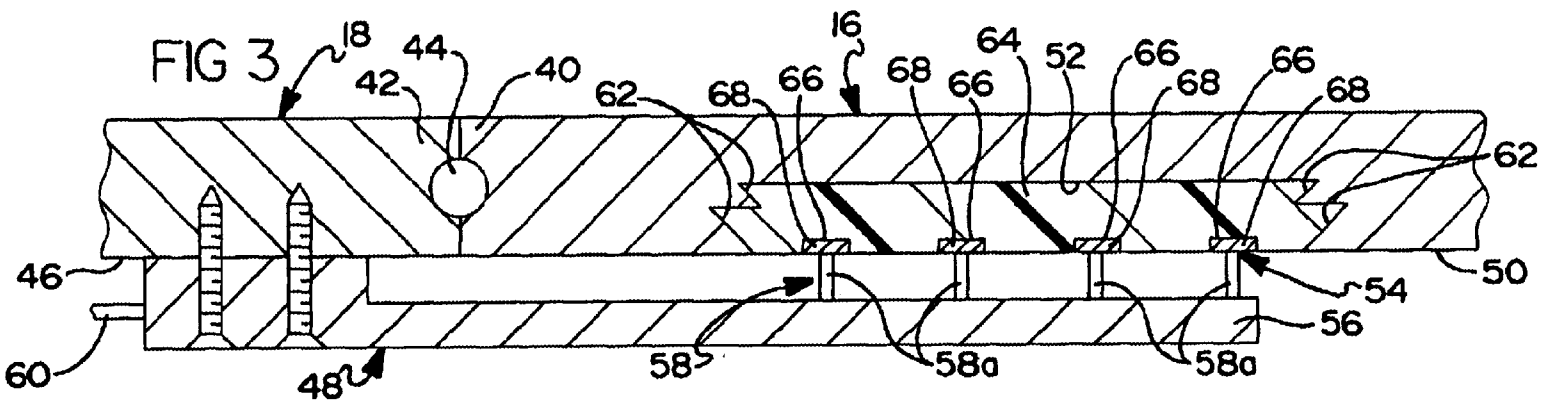
FIG. 3 is a cross-sectional view of a different portion of the apparatus of FIG. 1 taken in accordance with section line 3—3 in FIG. 1.

Referring to FIG. 3, the stationary platform 18 can also be seen to include a lower surface 46 to which a support bracket 48 is fixedly secured. The movable platform 16 also includes a lower surface 50 having an annular cavity 52 within which is formed a slip ring assembly 54. The support bracket 48 has a length sufficient to extend underneath the slip ring assembly 54 and an outer most end 56 which supports a brush assembly 58 thereon. The brush assembly 58 includes a plurality of independent electrical brushes 58*a*. The brushes 58*a* of the brush assembly 58 are in contact with the slip ring assembly 54 to thus form a path through which electrical signals can be transmitted between the brush assembly 58 and the slip ring assembly 54. In this regard, it will be appreciated that electrical conductors leading to the elevation motor 32 and the azimuth motor 28 extend into contact with the slip ring assembly 54 such that electrical signals transmitted to the assembly 54 can be further transmitted to the motors 28 and 32, as well as other electrical components mounted on the movable platform 16. For convenience, these additional conductors have not been shown, but it will be appreciated that additional holes may be formed in the movable platform 16 through which the additional conductors can be coupled to the slip ring assembly 54. It will also be appreciated that the brush assembly 58 includes a cable assembly 60 which can be used to communicate electrical signals to and from the brush assembly 58. The cable assembly 60 may be formed to extend through an interior assembly (not shown) in the support bracket 48 or could be supported along an outer surface of the support bracket 48.

Figure 4:
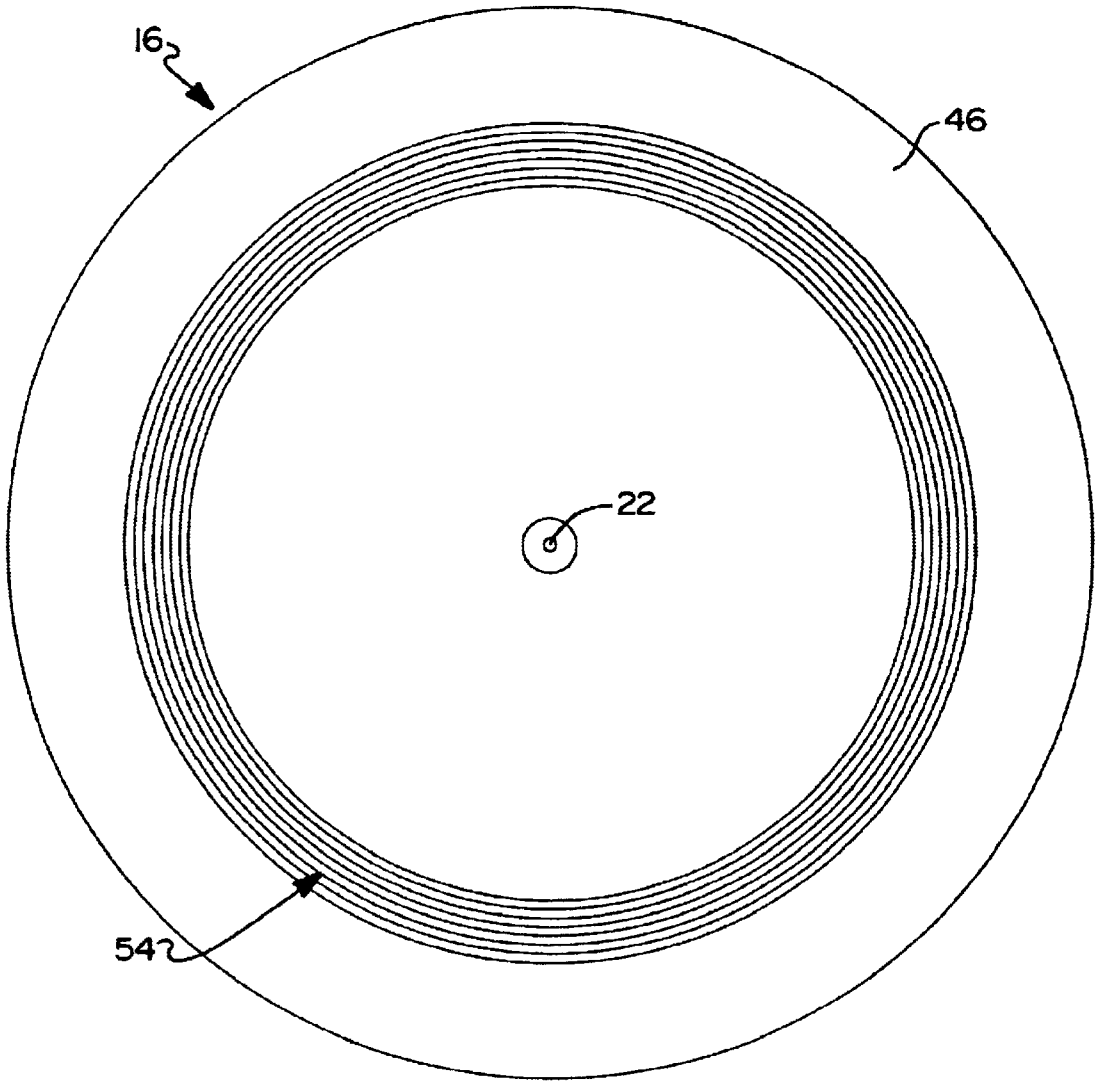
FIG. 4 is a plan view of the lower surface of the movable platform.

With further reference to FIGS. 3 and 4, the slip ring assembly 54 will be described in greater detail. With brief reference to FIG. 4, it will be noted that the slip ring assembly 54 forms an annular shape concentric with the azimuth pivot axis 22 (FIG. 1). The slip ring assembly 54 is formed by first machining the movable platform 16 such that the lower surface 46 is flat. Next, the cavity 52 is formed by removing a suitable amount of material from the lower surface 46. Preferably, the movable platform 16 is made of stainless steel to provide a suitable surface against which the bearing assembly 44 can contact. Stainless steel also provides protection against corrosion and thermal contraction/expansion problems.

The cavity 52 is preferably formed such that tapered edges 62 are formed at the center and at opposite ends of the cavity 52. Once the cavity 52 is formed, an appropriate plastic insulating material, possibly phenolic or epoxy, is injection molded into the cavity to form an insulated base 64. Next, a plurality of grooves 66 are machined into the insulated base 64. Alternatively, the grooves 66 may be formed during the injection molding process provided the molding tool used can be constructed with suitable circular, concentric circular portions to form the grooves 66.

Once the grooves 66 are formed, the insulated base 64 is electroplated with a standard series of metallic coatings terminating in a final electro-plated filling of gold. These conductive fillings are denoted by reference numeral 68 and form independent slip rings. The final step is again machining the lower surface 46 of the movable platform 16 to remove the excess over-plating of gold and thereby provide a uniform, flat surface for the entire lower surface 46.

The brush assembly 58 comprises a number of brushes 58*a* which correspond to the number of conductive slip rings 68 formed on the movable platform 16. The slip ring brushes 58*a* are preferably formed as gold plated, beryllium copper, spring-like devices that slide over the slip rings 68 as the movable platform 16 rotates. It will also be appreciated that the brushes 58*a* of the brush assembly 58 are preferably designed so as to be curved in accordance with the curvature of the slip rings 68.

A principle advantage of forming the slip rings 68 on the lower surface 46 of the movable platform 16 is that any moisture that reaches the surface of the slip ring 68 will readily run-off. The slip rings 68 are also much less likely to become contaminated with miscellaneous debris that might fall onto the slip rings during use of the antenna system 10.

Still another positive feature of the movable platform 16 is that it is possible to embed an electrical heating wire (or wires) into the insulated base 64 during manufacture of the movable platform 16. Electric current can then be supplied to the heating wire (or wires) in a controlled manner to generate a controlled degree of heat to avoid formation of ice on the slip rings 68 and the movable platform 16.

To further increase reliability of the antenna system 10, a redundant set of brushes of the brush assembly 58 could be mounted on the support bracket 48 or on another suitable support bracket. In this manner, the mean time between failures (MTBF) could be increased for the antenna system 10. Increasing the MTBF effectively reduces the cost of service and maintaining the antenna system 10 over a given period of time.

The antenna system 10 of the present invention thus provides a means for reducing the overall height of an antenna that is to be secured to an exterior surface of a mobile platform. Importantly, this allows the drag associated with the antenna system 10 to be minimized when the mobile platform to which it is mounted is moving at a high rate of speed. The antenna system 10 further is constructed in a manner which improves reliability by placing the slip ring on the lower surface of the movable platform 16, in contrast to previously developed movable platforms where the slip rings are located on the upper surface.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification and following claims.

What is claimed is:

1. An antenna system adapted to be mounted on a structure, comprising:

a stationary platform mounted on said structure;

a moveable platform disposed adjacent said stationary platform;

an antenna mounted on said moveable platform;

a motor for driving said moveable platform rotationally relative to said stationary platform about a rotational axis;

at least one slip ring disposed on a surface of one of said stationary or moveable platforms in a plane generally parallel to a plane in which said moveable platform resides;

at least one brush disposed adjacent said slip ring to thereby contact said slip ring as said moveable platform is rotated by said motor;

a support for supporting said brush; and wherein said brush and said slip ring provide a continuous electrical connection for providing an electrical signal to at least one electrical component associated with said antenna.

2. The system of claim 1, wherein said stationary platform comprises an annular platform; and wherein said moveable platform comprises a circular platform.

3. The system of claim 1, wherein said slip ring is disposed on an undersurface of said moveable platform.

4. The system of claim 1, further comprising a motor support bracket for supporting said motor fixedly relative to said moveable platform such that said motor rotates with said moveable platform.

5. The system of claim 2, further comprises a bearing assembly interposed between an outer edge surface of said circular platform and an inner edge of said annular platform.

6. The system of claim 5, wherein said circular platform is disposed coplanar with annular platform.

7. An antenna system adapted to be mounted on a structure, comprising:

a stationary annular platform mounted on said structure;

a moveable circular platform disposed adjacent said stationary annular platform and having an upper surface and a lower surface;

an antenna mounted on said moveable circular platform;

a motor operatively coupled to said moveable circular platform for driving said moveable circular platform rotationally relative to said stationary platform about a rotational axis;

at least one slip ring disposed on a surface of one of said platforms in a plane generally parallel to a plane in which said moveable platform resides;

at least one brush disposed adjacent said slip ring to thereby contact said slip ring as said moveable platform is rotated by said motor;

a support operatively associated with said stationary annular platform for supporting said brush; and wherein said brush and said slip ring provide a continuous electrical connection for providing an electrical signal to at least one electrical component associated with said antenna.

8. The system of claim 7, further comprising a bearing assembly interposed between an outer edge surface of said moveable circular platform and an inner surface of said stationary annular platform for facilitating smooth rotational movement of said moveable circular platform relative to said stationary annular platform.

9. The system of claim 8, wherein said motor includes a gear, and wherein said stationary annular platform includes an outer surface having a toothed structure for engaging said gear.

10. The system of claim 7, wherein said slip ring is disposed on a lower surface of said moveable circular platform.

11. The system of claim 7, wherein said moveable circular platform includes a plurality of concentrically disposed slip rings and a plurality of brushes.

12. The system of claim 7, wherein each of said platforms includes an upper surface and a lower surface, and wherein said stationary annular platform is disposed generally coplanar with said moveable circular platform.

13. A method for mounting an antenna for rotational movement about an azimuthal axis, said method comprising:

using a moveable platform mounted for rotational movement on a substructure to support said antenna on an upper surface thereof;

disposing a stationary platform mounted on said substructure adjacent said moveable platform;

using a motor operably associated with said moveable platform and said stationary platform to rotate said moveable platform about said azimuthal axis;

disposing a slip ring on a surface of one of said platforms in a plane generally parallel to a plane in which said moveable platform resides; and supporting a brush adjacent said slip ring to continuously contact said slip ring as said moveable platform is rotated, whereby said brush and said slip ring cooperate to pass electrical signals therebetween.

14. The method of claim 13, further comprising the step of disposing said platforms generally coplanar with one another.

15. The method of claim 13, wherein:

the step of using a moveable platform comprises using a moveable circular platform; and the step of using a stationary platform comprises using a stationary annular platform disposed generally coplanar with said moveable circular platform.

16. The method of claim 13, further comprising using a bearing assembly disposed between said platforms to facilitate smooth rotational movement stationary platform.

17. The method of claim 13, further comprising:

disposing a plurality of slip rings on said moveable platform; and using a plurality of brushes to contact said plurality of slip rings.

18. The method of claim 13, wherein:

the step of disposing a slip ring comprises disposing a slip ring on said moveable platform; and the step of supporting a brush comprises supporting a brush from said stationary platform.

* * * * *

UNITED STATES PATENT AND TRADEMARK OFFICE

CERTIFICATE OF CORRECTION

PATENT NO. : 6,633,266 B2
DATED : October 14, 2003
INVENTOR(S) : Albert Louis Bien et al.

It is certified that error appears in the above-identified patent and that said Letters Patent is hereby corrected as shown below:

Title page,
Item [75], Inventors, "Blen" should be -- Bien --

Column 3,
Line 23, "supper" should be -- upper --

Signed and Sealed this

Second Day of December, 2003

JAMES E. ROGAN
*Director of the United States Patent and Trademark Office*